US007662067B2

(12) United States Patent
Payne

(10) Patent No.: US 7,662,067 B2
(45) Date of Patent: Feb. 16, 2010

(54) EXERCISE APPARATUS

(76) Inventor: Clive Anthony Payne, 93 Carbery Avenue, Southbourne, Bournemouth, Dorset, BH6 3LP (GB)

( * ) Notice: Subject to any disclaimer, the term of this patent is extended or adjusted under 35 U.S.C. 154(b) by 368 days.

(21) Appl. No.: 10/568,847

(22) PCT Filed: Nov. 21, 2003

(86) PCT No.: PCT/GB03/05068

§ 371 (c)(1),
(2), (4) Date: Feb. 17, 2006

(87) PCT Pub. No.: WO2005/018751

PCT Pub. Date: Mar. 3, 2005

(65) Prior Publication Data

US 2006/0217246 A1 Sep. 28, 2006

(30) Foreign Application Priority Data

Aug. 20, 2003 (GB) ..... 0319508.8
Oct. 16, 2003 (GB) ..... 0324181.7

(51) Int. Cl.
*A63B 21/00* (2006.01)
*A63B 1/00* (2006.01)

(52) U.S. Cl. ..... 482/38; 482/95; 482/140; 482/141; 482/907

(58) Field of Classification Search ..... 482/38, 482/91, 95, 141, 144, 907, 140
See application file for complete search history.

(56) References Cited

U.S. PATENT DOCUMENTS 3,540,724 A * 11/1970 Hunter ..... 482/142
4,503,845 A * 3/1985 Licciardi ..... 606/241
4,620,701 A * 11/1986 Mojden ..... 482/41
4,638,995 A * 1/1987 Wilson ..... 482/142
D320,823 S * 10/1991 Tanner ..... D2/686
5,135,459 A 8/1992 Perry, Jr. ..... 482/144
5,290,209 A 3/1994 Wilkinson ..... 482/38
5,299,990 A * 4/1994 Mehlhoff ..... 482/38
5,582,565 A 12/1996 Soria ..... 482/141
5,695,436 A * 12/1997 Huang ..... 482/121
5,746,688 A * 5/1998 Prager ..... 482/142
5,928,119 A * 7/1999 Dinkel ..... 482/141
6,203,473 B1 * 3/2001 Atwood ..... 482/95
6,692,417 B2 * 2/2004 Burrell ..... 482/142
6,695,754 B1 * 2/2004 Gazzolo ..... 482/141

(Continued)

*Primary Examiner*—Loan H Thanh
*Assistant Examiner*—Victor K Hwang
(74) *Attorney, Agent, or Firm*—Porzio, Bromberg & Newman, P.C.

(57) ABSTRACT

An exercise apparatus comprises at least one upright joined to a cross bar provided with a limb support means. The limb support comprises an upright connecting cross bar of such a length that the cross bar is spaced from the floor sufficiently such that, in use, the legs of the user can rest on the cross bar when the user is positioned beneath the cross bar. The cross bar also being sufficiently spaced from the floor such that, in use, the limb support comprises a handgrip to enable a user to push down on the exercise apparatus so that the exercise apparatus supports at least some of the user's weight. The limb support comprises two outer concave regions that are relatively spaced along the longitudinal axis of the cross bar. The cross bar is provided with a third inner concave region in between the two outer concave regions.

23 Claims, 4 Drawing Sheets

U.S. PATENT DOCUMENTS 6,770,013 B2 * 8/2004 Stillinger ..... 482/91
6,926,647 B1 * 8/2005 Huang et al. ..... 482/72
6,932,750 B1 * 8/2005 Dorner ..... 482/142
D525,668 S * 7/2006 Payne ..... D21/691
7,144,353 B2 * 12/2006 Sjuragari ..... 482/142
2005/0187083 A1 * 8/2005 Krystoff ..... 482/140
2009/0124471 A1 * 5/2009 Storch ..... 482/141

* cited by examiner

EXERCISE APPARATUS

The present invention relates to an exercise apparatus and particularly but not exclusively relates to a free standing exercise apparatus for use by a single user to develop the major and minor muscles in the upper half of the human body.

It has previously been proposed to provide an exercise apparatus to enable a user to perform multiple repetitive exercises to improve the condition of the upper half of the human body. Such prior apparatus can be relatively large, complex, expensive and unwieldy and not necessarily suitable for the plurality of different exercises that a user may wish to perform.

According to a first aspect of the invention there is provided an exercise apparatus comprising at least one upright joined to a cross bar provided with a limb support means, the upright being of such a length that the cross bar is spaced from the floor sufficiently such that, in use, the limb support means comprises a leg support means to be positioned beneath, and to support, the legs of the user when the user is positioned beneath the cross bar, the cross bar also being sufficiently spaced from the floor such that, in use, the limb support means comprises a hand grip means to enable a user to push down on the exercise apparatus so that the exercise apparatus supports at least some of the user's weight.

Preferably the limb support means comprises two limb supports that are relatively spaced along the longitudinal axis of the cross bar.

Preferably the cross bar is provided with a third limb support in between the two limb supports.

Preferably the exercise apparatus comprises two spaced apart uprights.

Preferably each limb support is adjacent a respective upright.

Preferably the cross bar is further provided with at least two additional limb supports that are also relatively spaced along the longitudinal axis of the cross bar, but which extend perpendicularly away from the longitudinal axis of the cross bar.

Preferably the additional limb supports are positioned between the two other limb supports so as to be spaced from the uprights.

Preferably each additional limb support terminates in a further limb support the longitudinal axis of which is substantially perpendicular to the longitudinal axis of the respective additional limb support.

Preferably the exercise apparatus comprises adjustment means operative to vary the orientation of the further limb support relative to the respective additional limb support.

Preferably the adjustment means is operative such that the further limb support can be rotated through 360° about the longitudinal axis of the respective additional limb support.

Preferably the adjustment means is operative such that the orientation of the further limb support can be adjusted to a plurality of discrete positions relative to the additional limb support.

Preferably the adjustment means comprises a plug formed on one of the additional or further limb supports, and a socket on the other of the additional or limb supports, the socket, in use, receiving the plug and engaging the plug to retain the plug in an orientation relative to the socket, the orientation being adjustable by removing the plug from the socket and reinserting the plug in the socket in a different orientation.

Preferably the plug and socket are both of square cross section so that the plug can be received in the socket in one of four discrete orientations.

Preferably the limb supports are concave so as to positively locate the limb of the user on the limb supports. Thus the two limb supports and the third limb support together are of waved formation.

Preferably the uprights and the cross bar are removably joined together such that the exercise apparatus is collapsible.

However the uprights and the cross bar may alternatively comprise a single, integral, non collapsible exercise apparatus.

Preferably the or each upright comprises a base portion which rests, in a first condition, in use, on the floor, and an arm portion extending away from the base portion and the floor, the cross bar being joined to the arm portion at a position distal from the base portion.

Preferably the arm portion extends away from one end of the base portion to a position substantially above the mid point of the base portion. The base portion thus, when viewed in plan, extends away from both sides of the longitudinal axis of the cross bar so as to provide stability to the exercise apparatus to resist the exercise apparatus tipping over in use.

Preferably the orientation of each arm portion relative to the respective base portion is such that the exercise apparatus can be used in a second condition wherein the exercise apparatus has been rotated through approximately 90° so that the cross bar is adjacent, in use in the second condition, the floor.

Preferably the arm portion is inclined from the base portion.

Preferably the angle between the arm portion and the base portion is between 30° and 90°. Most preferably the angle is substantially 45°. Alternatively the arm portion extends substantially perpendicularly from the base portion. The arm portion may be curved.

Preferably each base portion is formed with a hand grip.

Preferably the orientation of each hand grip relative to the respective base portion is adjustable.

Preferably the orientation of each hand grip is adjustable by rotating the longitudinal axis of the hand grip relative to the respective base portion about an axis that is perpendicular to the longitudinal axis of the base portion.

Preferably the orientation of each hand grip is adjustable to a plurality of discrete positions. Most preferably the orientation of each hand grip is adjustable to four discrete positions.

Other aspects of the present invention may include any combination of the features or limitations referred to herein.

The present invention may be carried into practice in various ways, but embodiments will now be described by way of example only with reference to the accompanying drawings in which.

Figure 1:
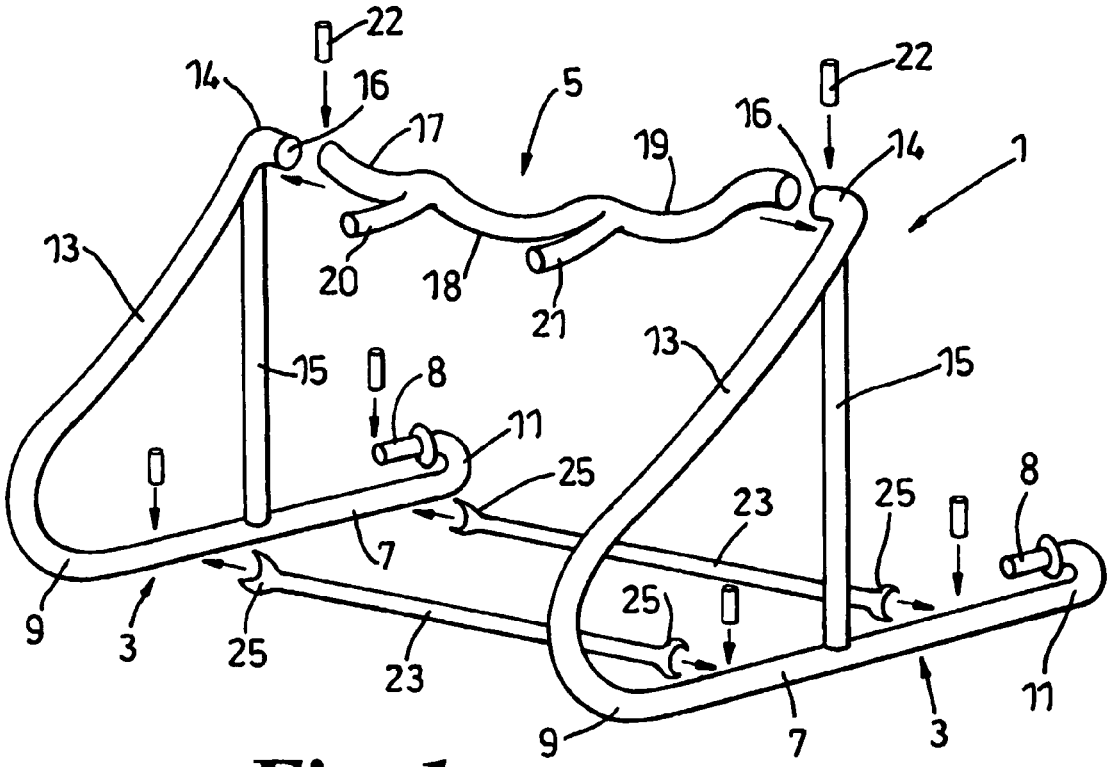
FIG. 1 is an exploded perspective view of the components of an exercise apparatus in accordance with the present invention.
Figure 2:
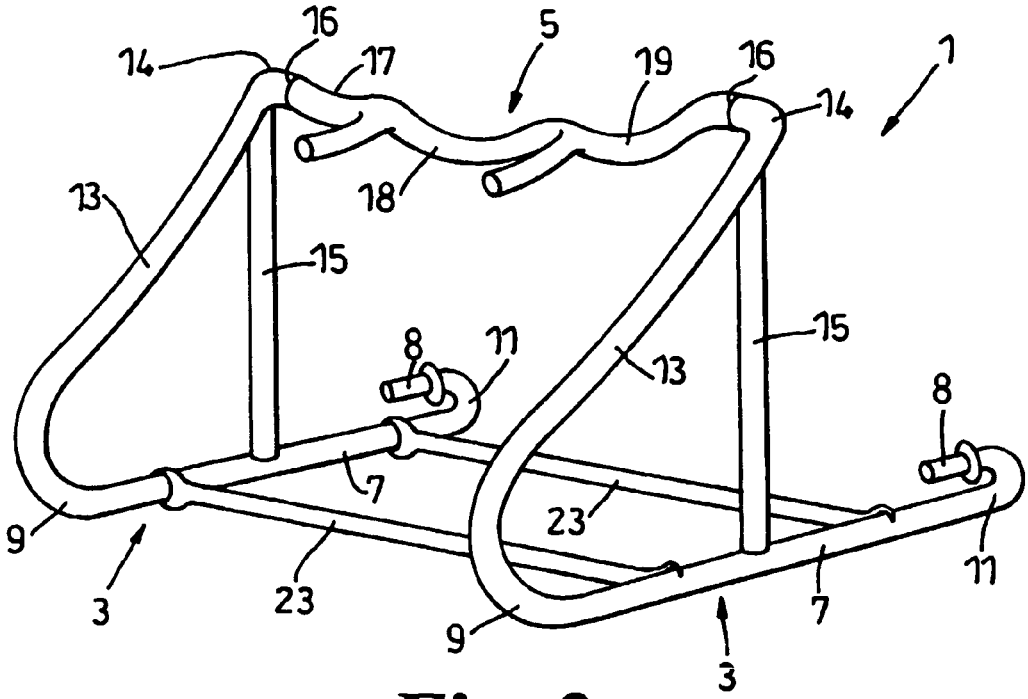
FIG. 2 is a perspective view of the exercise apparatus of FIG. 1 in an assembled condition.

Referring to FIGS. 1 and 2, an exercise apparatus 1 comprises two spaced apart substantially vertical uprights 3 joined together by a single, substantially horizontal cross bar 5. The uprights 3 and the cross bar 5 are made from a tubular metal material although any other suitable material may alternatively be used.

Each upright 3 comprises a horizontal base portion 7 having two ends 9, 11, and an arm portion 13 extending upwardly away from end 9 of the base portion 7. The arm portion 13 of each upright 3 is inclined relative to the base portion 7 and is of a length such that distal end 14 of the arm portion 13 terminates at a position substantially above the point midway between the two ends 4, 11 of the base portion 7. A brace 15 extends vertically between the distal end 14 of the arm portion 13 and the point mid way between the two ends 9, 11 of the base portion 7.

The end 11 of each upright 3 is provided with a handle 8.

The distal end 14 of each arm portion 13 is provided with an inwardly directed socket 16 adapted to receive an end of the cross bar 5.

The cross bar 5 comprises an elongate bar that is curved along its length so as to define three concave regions 17, 18, 19. The cross bar 5 thus resembles a wave along its longitudinal axis. At the intersection between the concave regions 17 and 18, and the intersection between the concave regions 18 and 19, are provided respective short beams 20, 21 which each extend perpendicularly away from the longitudinal axis of the cross bar 5.

The concave regions 17, 18, 19 and the short beams 20, 21 each comprise limb supports together forming limb support means to support part of the user of the exercise apparatus 1.

To assemble the exercise apparatus 1, the ends of the cross bar 5 are inserted into the sockets 16 provided on the arm portions 13 of the uprights 3. Securing means 22 such as a bolt or split pin are provided to secure the ends of the cross bar 5 in the sockets 16.

Additionally, cross braces 23 are provided and extend between the base portions 7 of the uprights 3 to further strengthen the exercise apparatus 1. The ends of each cross brace 23 terminate in a cupped region 25 dimensioned to partially receive the respective base portion 7 and any suitable securing means 25 such as a bolt or split pin can be provided to secure the cross braces 23 between the base portions 7. Thus it will be appreciated that the exercise apparatus 1 is collapsible and can be disassembled by reversing the above procedure so that the exercise apparatus 1 can be stored in a relatively flat condition.

When assembled, the cross bar 5 is spaced from the base portions 7 of the uprights 3 and is thus spaced from the surface on which the exercise apparatus 1 is placed. It is envisaged that the exercise apparatus 1 would be used on a planar surface such as a floor. A padded exercise mat may be provided between the planar surface and the exercise apparatus 1.

It will be appreciated that the arm portions 13 extend away from the base portions 7 a distance sufficient that a user of the exercise apparatus 1 can lie between the uprights 3 and beneath the cross bar 5. However, the cross bar 5 is also spaced from the base portions 7 sufficiently that a user can stand adjacent the cross bar 5 so that the cross bar 5 is located about waist height of the average user.

To develop the muscles of the outer back, shoulder and biceps, the user can lie beneath the cross bar 5 with his hands gripping the outer concave regions 17, 19 of the cross bar 5. His hands are thus spaced apart in a relatively wide grip and are adjacent the uprights 3. The user can then pull his upper body towards and away from the cross bar 5.

To develop the muscles of the inner back, shoulder and biceps, the user can again lie beneath the cross bar 5 but with his hands gripping the inner concave region 18 of the cross bar 5. His hands are thus close together in a relatively narrow grip remote from the uprights 3. Again the user can pull his upper body towards and away from the cross bar 5.

To develop the abdominal muscles, the user lies adjacent the exercise apparatus 1 with the back of his knees resting on respective concave regions 17 and 19. Thus his upper body and thighs are positioned on one side of the cross bar 5 and the lower legs are positioned on the other side of the cross bar 5. The user can then flex his upper body towards and away from the cross bar 5 so as to perform a sit up type exercise.

To develop the chest and shoulder muscles, and triceps, the user stands adjacent and facing the exercise apparatus and grips the outer concave regions 17, 19 with his hands. The use can then lower his upper body towards the cross bar 5. This can be achieved with the feet of the user on or off the floor.

Finally, to develop the triceps the user can stand adjacent but with his back to the exercise apparatus and again grip the outer concave regions 17, 19 with his hands. By flexing his arms, the user lowers his upper body towards the cross bar 5.

Thus the exercise apparatus 1 provides a compact, simple, strong apparatus for performing a plurality of different exercises by providing a plurality of supports for the hands and legs at a height such that the user can stand above or lie beneath the cross bar.

Figure 3:
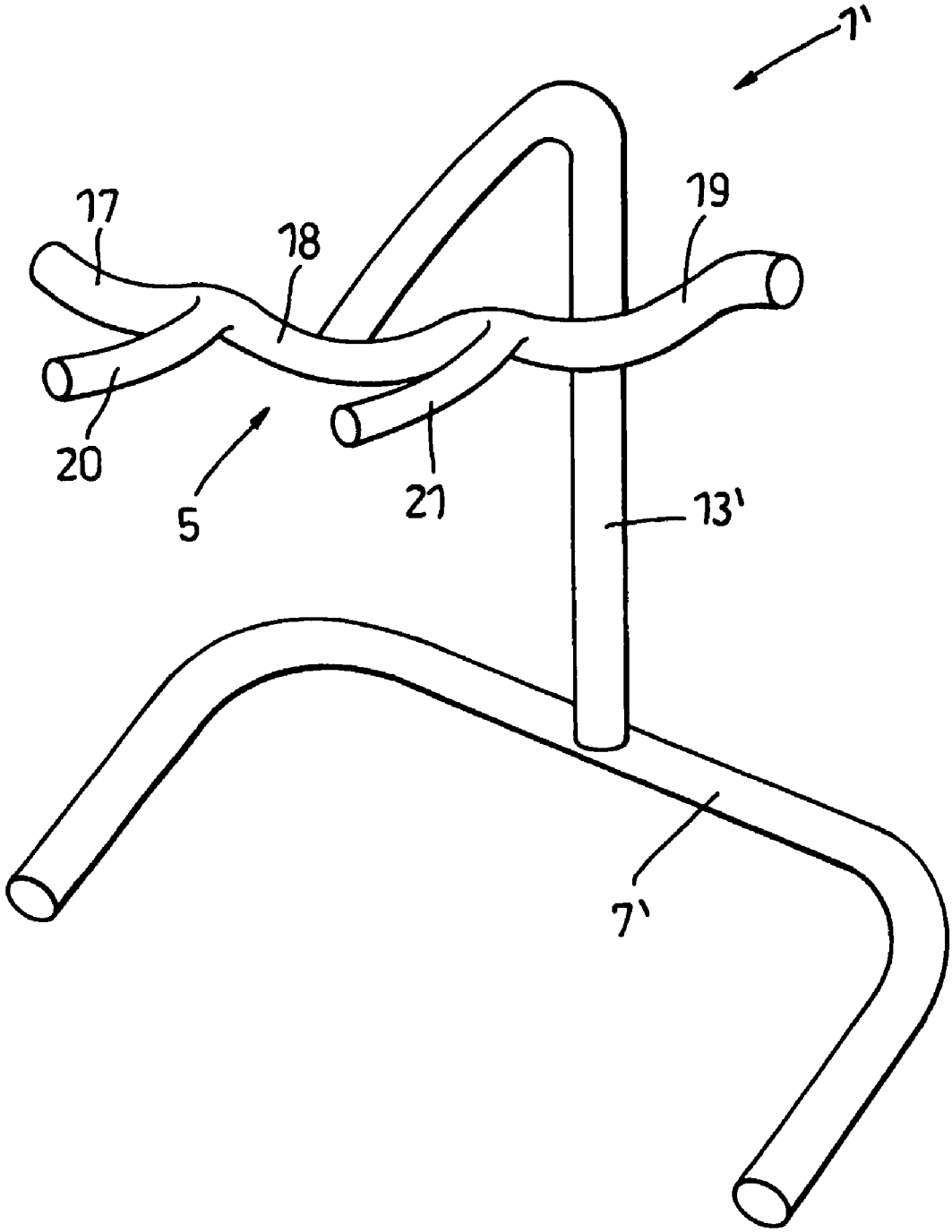
FIG. 3 is a perspective view of an alternative embodiment of the exercise apparatus in accordance with the present invention.

FIG. 3 shows an alternative exercise apparatus 1' having similar features to the apparatus 1 of FIGS. 1 and 2, but provided with a single, centrally located upright 13' mounted on a C-shaped base portion 7'.

Figure 4:
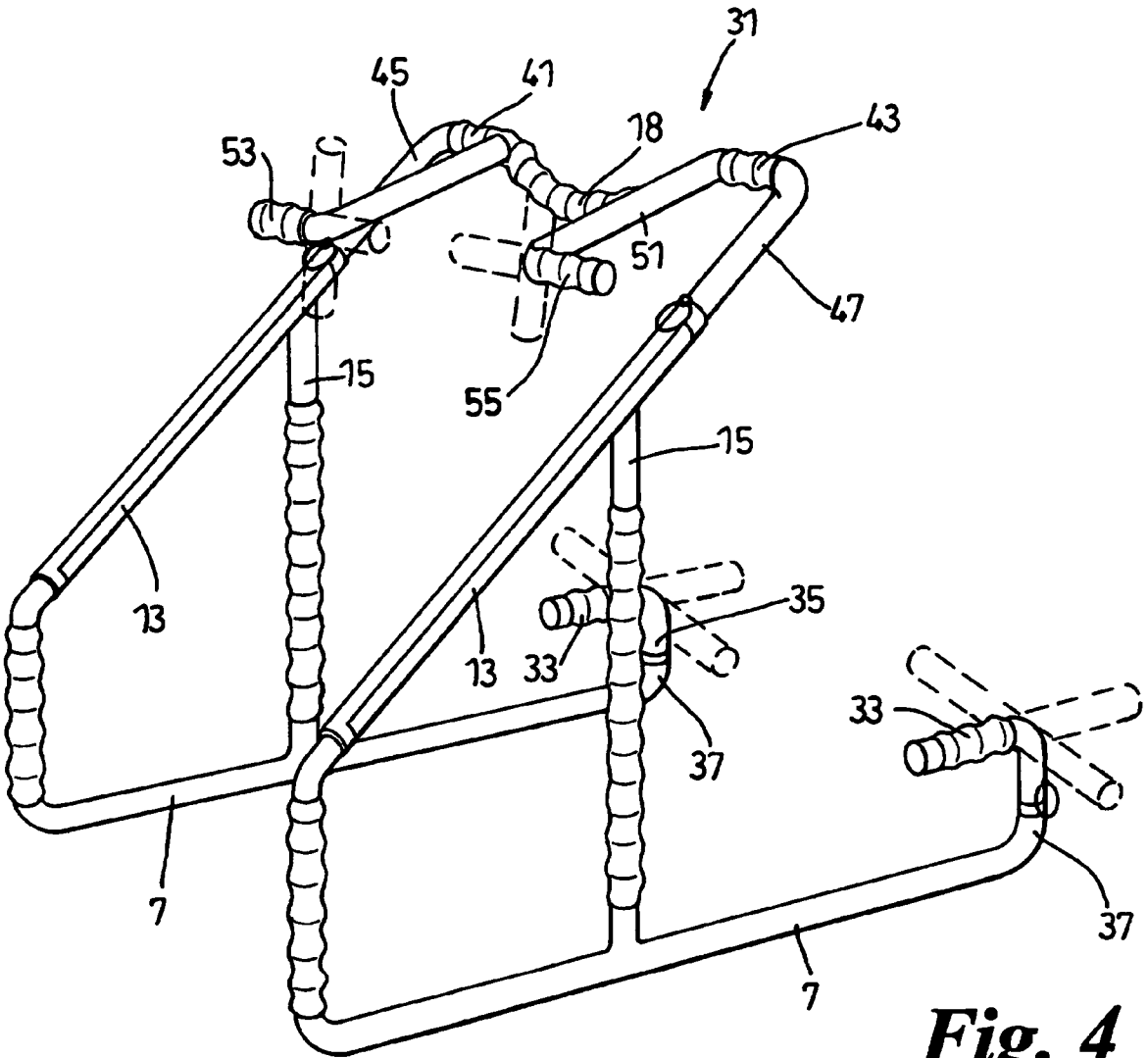
FIG. 4 is a perspective view of a further alternative embodiment of the exercise apparatus in accordance with the present invention with the exercise apparatus in a first condition.
Figure 5:
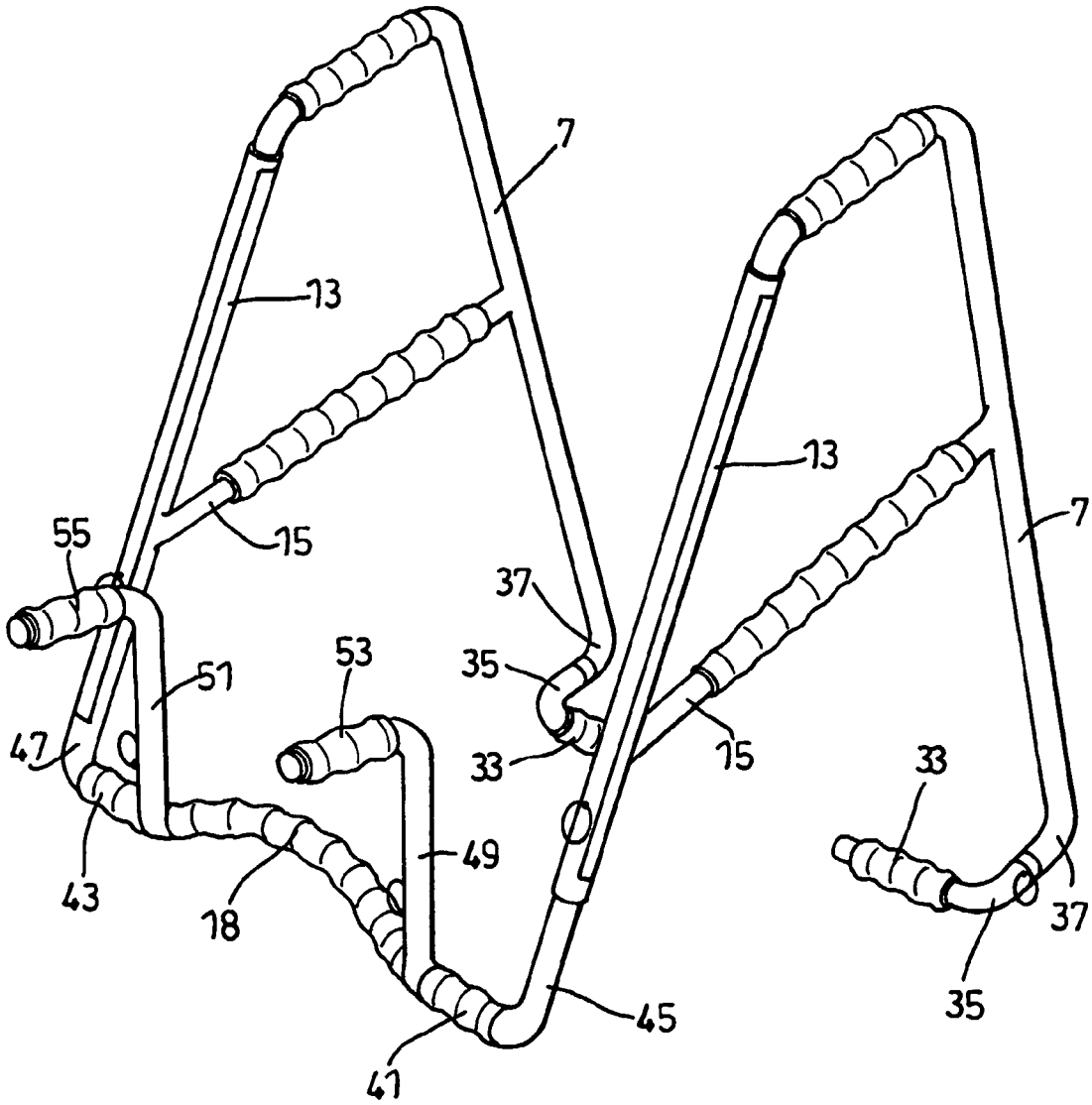
FIG. 5 is an end view of the exercise apparatus of FIG. 4 in a second condition.

Referring now to FIGS. 4 and 5 an alternative exercise apparatus 31 is shown with like features being given like references. In this embodiment, handles 33 are mounted on the ends of base portions 7 so as to be substantially parallel with the respective base portion 7. This is achieved by part of each handle 33 bending through 90° to form a downwardly extending plug 35 which is received in an upwardly extending socket 37 formed at the end of each base portion 7. The plug 35 and socket 37 are such that the handle 33 can be rotated about the longitudinal axis of the socket 37 through 360°. This enables the handle 33 to be parallel with the base portion 7 and extending either towards or away from the upright 3, or perpendicular to the base portion 7 and extending towards or away from the other base portion 7. This can be achieved by forming the socket 37 with a square internal cross section, the plug 35 having a complimentary square cross section. Any other suitable cross section could alternatively be used. The different positions of the handles 33 are shown in phantom.

The cross bar 39 of the exercise apparatus 31 comprises a central concave region 18 and two outer substantially straight regions 41, 43. Each outer region 41, 43 terminates in a region 45, 47 respectively that is positioned at 90° to the longitudinal axis of the cross bar 39, each region 45, 47 being received in the top of a respective upright 3 to mount the cross bar 39 on the uprights 3.

At the intersection between the concave region 18 and each straight region 41, 43 are respective short beams 49, 51 that extend perpendicularly away from the longitudinal axis of the cross bar 39. A handle 53, 55 is provided at the end of each short beam 49, 51, each handle 53, 55 being rotatable about the axis of the respective beam 49, 51 by 360°. This allows the orientation of the handles 53, 55 to be adjusted relative to the longitudinal axis of the cross bar 39.

Any suitable adjustment means can be provided to effect this adjustment, for example the handles 53,55 may be of square cross section to be received in a square cross section socket portion at the end of each short beam 49, 51. Alternatively the handles 53,55 may be of circular cross section to slide over or be received within circular cross section portions of the respective short beam 49, 51, a grub screw or Allen bolt or the like being provided to clamp the handle 53, 55 in a particular orientation relative to the respective short beam 49, 51. Quick release means comprising pins having rings attached can be provided to be received in suitable apertures in the handles 53, 55 and the short beams 49, 51.

In addition the braces 15 are provided with handles 15A which extend along substantially half of the length of each brace 15. The lower portions of each arm portion 13 are also provided with handles 13A. The handles 13A and 15A comprise ribbed rubber plastic or neoprene sleeves that are slid onto the arm portions 13 or the braces 15 respectively.

The adjustable cross bar handles 53, 55, the adjustable base handles 33 and the additional handles 13A, 15A enable further adjustment of the exercise apparatus 31 to be made so that a user of the exercise apparatus 31 can use the exercise apparatus 31 to perform a greater range of different exercises, including dips, pull-ups with the hands relatively close together or spaced-apart, and abdominal exercises. In addition, the exercise apparatus 31 allows some adjustment to enable users of different sizes to use the apparatus 31.

Finally, different handle orientations enable different difficulties of the same exercises to be performed. Finally, the exercise apparatus 31 is ordinarily used with the base portions 7 resting on the floor as shown in FIG. 5. However, it will be appreciated that the exercise apparatus 31 can alternatively be used in an alternative orientation with the cross bar 39 and the handles 33 resting on the floor. That is the exercise apparatus 31 can be rotated through approximately 90° so that the intersection of the base portions 7 with the uprights 3, is uppermost. This is enabled by the angle between the base portions 7 and the respective upright 3 being sufficient that the exercise apparatus 31 is stable when rotated to the alternative orientation. It is envisaged that an angle between 45° and 90° be suitable. The alternative orientation of the exercise apparatus 31 repositions the handles 33, 53, 55, 13A and 15A to enable the user to carry out yet further exercises using the same exercise apparatus 31 including, for example, dips, squats to strengthen the legs, and chest and shoulder exercises.

The invention claimed is:

1. An exercise apparatus comprising two spaced apart uprights joined to a cross bar provided with a limb support means, the upright being of such a length that the cross bar is spaced from the floor sufficiently such that, in use, the limb support means supports the legs of the user when the user is positioned beneath the cross bar, the cross bar also being sufficiently spaced from the floor such that, in use, the limb support means comprises a hand grip means to enable a user to push down on the exercise apparatus so that the exercise apparatus supports at least some of the user's weight, the limb support means comprising a concave limb support formed centrally on the cross bar, each of said uprights comprising a base portion which rests, in a first condition, in use, on the floor such that said concave limb support is concave in a generally vertical plane and in a direction generally perpendicular to said base portion, and an arm portion extending away from the base portion and the floor at an oblique angle, the cross bar being joined to the arm portion at a position of the arm portion distal from the base portion, an orientation of the arm portion relative to the base portion being such that the exercise apparatus can be used in a second condition wherein the exercise apparatus has been rotated though approximately 90° so that the cross bar is adjacent, in use in the second condition, the floor.

2. The exercise apparatus of claim 1 wherein the limb support means comprises two outer limb supports that are relatively spaced along the longitudinal axis of the cross bar on respective sides of the concave limb support.

3. The exercise apparatus of claim 2 wherein each of the two outer limb supports are adjacent a respective one of said uprights.

4. The exercise apparatus of claim 3 wherein the uprights and the cross bar are removably joined together such that the exercise apparatus is collapsible.

5. The exercise apparatus of claim 2 wherein the cross bar is further provided with at least two perpendicular limb supports that are also relatively spaced along the longitudinal axis of the cross bar and which extend perpendicularly away from the longitudinal axis of the cross bar.

6. The exercise apparatus of claim 5 wherein the perpendicular limb supports are positioned between the two outer limb supports so as to be spaced from the uprights.

7. The exercise apparatus of claim 5 wherein each of said perpendicular limb supports terminates in a handle limb support the longitudinal axis of which is substantially perpendicular to the longitudinal axis of the respective perpendicular limb support.

8. The exercise apparatus of claim 7 wherein the exercise apparatus comprises adjustment means operative to vary the orientation of the further handle support relative to the respective perpendicular limb support.

9. The exercise apparatus of claim 8 wherein the adjustment means is operative such that the orientation of the handle limb support can be adjusted to a plurality of discrete positions relative to the perpendicular limb support.

10. The exercise apparatus of claim 8 wherein the adjustment means comprises a plug formed on one of the perpendicular or handle limb supports, and a socket on the other of the perpendicular or handle limb supports, the socket, in use, receiving the plug and engaging the plug to retain the plug in an orientation relative to the socket, the orientation being adjustable by removing the plug from the socket and reinserting the plug in the socket in a different orientation.

11. The exercise apparatus of claim 2 wherein the two outer limb supports are concave in a vertical plane so as to positively locate the limb of the user on the two outer limb supports.

12. The exercise apparatus of claim 11 wherein the two outer limb supports and the first concave limb support together are of waved formation.

13. The exercise apparatus of claim 1 wherein the arm portion extends away from one end of the base portion to a position substantially above the mid point of the base portion.

14. The exercise apparatus of claim 13 wherein the arm portion is inclined from the base portion.

15. The exercise apparatus of claim 14 wherein the angle between the arm portion and the base portion is between 30° and 90°.

16. The exercise apparatus of claim 15 wherein the angle is substantially 45°.

17. The exercise apparatus of claim 1 wherein the base portion is provided with a handgrip.

18. The exercise apparatus of claim 17 wherein the orientation of each handgrip relative to the respective base portion is adjustable.

19. The exercise apparatus of claim 18 wherein the orientation of each handgrip is adjustable by rotating the longitudinal axis of the handgrip relative to the respective base portion about an axis that is perpendicular to the longitudinal axis of the base portion.

20. The exercise apparatus of claim 18 wherein the orientation of each handgrip is adjustable to a plurality of discrete positions.

21. The exercise apparatus of claim 20 wherein the orientation of each handgrip is adjustable to four discrete positions.

22. An exercise apparatus comprising two spaced apart uprights joined to a cross bar provided with a limb support means, the upright being of such a length that the cross bar is spaced from the floor sufficiently such that, in use, the limb support means supports the legs of the user when the user is positioned beneath the cross bar, the cross bar also being sufficiently spaced from the floor such that, in use, the limb support means comprises a hand grip means to enable a user to push down on the exercise apparatus so that the exercise apparatus supports at least some of the user's weight, the limb support means comprising a concave limb support formed centrally on the cross bar, each of said uprights comprising a base portion which rests, in a first condition, in use, on the floor, and an arm portion extending away from the base portion and the floor, the cross bar being joined to the arm portion at a position of the arm portion distal from the base portion, an orientation of the arm portion relative to the base portion being such that the exercise apparatus can be used in a second condition wherein the exercise apparatus has been rotated though approximately 90° so that the cross bar is adjacent, in use in the second condition, the floor, the cross bar is provided with at least two perpendicular limb supports that are also relatively spaced along the longitudinal axis of the cross bar and which extend perpendicularly away from the longitudinal axis of the cross bar, each of said perpendicular limb supports terminates in a handle limb support the longitudinal axis of which is substantially perpendicular to the longitudinal axis of the respective perpendicular limb support, the exercise apparatus comprises adjustment means operative to vary the orientation of the further handle support relative to the respective perpendicular limb support, wherein the adjustment means is operative such that the handle limb support can be rotated through 360° about the longitudinal axis of the respective perpendicular limb support.

23. An exercise apparatus comprising two spaced apart uprights joined to a cross bar provided with a limb support means, the upright being of such a length that the cross bar is spaced from the floor sufficiently such that, in use, the limb support means supports the legs of the user when the user is positioned beneath the cross bar, the cross bar also being sufficiently spaced from the floor such that, in use, the limb support means comprises a hand grip means to enable a user to push down on the exercise apparatus so that the exercise apparatus supports at least some of the user's weight, the limb support means comprising a concave limb support formed centrally on the cross bar, each of said uprights comprising a base portion which rests, in a first condition, in use, on the floor, and an arm portion extending away from the base portion and the floor, the cross bar being joined to the arm portion at a position of the arm portion distal from the base portion, an orientation of the arm portion relative to the base portion being such that the exercise apparatus can be used in a second condition wherein the exercise apparatus has been rotated through approximately 90° so that the cross bar is adjacent, in use in the second condition, the floor, the cross bar is provided with at least two perpendicular limb supports that are also relatively spaced along the longitudinal axis of the cross bar and which extend perpendicularly away from the longitudinal axis of the cross bar, each of said perpendicular limb supports terminates in a handle limb support the longitudinal axis of which is substantially perpendicular to the longitudinal axis of the respective perpendicular limb support, the exercise apparatus comprises adjustment means operative to vary the orientation of the further handle support relative to the respective perpendicular limb support, the adjustment means comprises a plug formed on one of the perpendicular or handle limb supports, and a socket on the other of the perpendicular or handle limb supports, the socket, in use, receiving the plug and engaging the plug to retain the plug in an orientation relative to the socket, the orientation being adjustable by removing the plug from the socket and reinserting the plug in the socket in a different orientation, wherein the plug and socket are both of square cross section so that the plug can be received in the socket in one of four discrete orientations.

* * * * *